United States Patent [19]

Kabachinski et al.

[11] Patent Number: 4,945,318

[45] Date of Patent: Jul. 31, 1990

[54] LOW FREQUENCY ISOLATOR FOR RADIO FREQUENCY HYPERTHERMIA PROBE

[75] Inventors: Jeffery L. Kabachinski, Boynton Beach, Fla.; Richard W. Fetter, Colgate, Wis.

[73] Assignee: Labthermics Technologies, Inc., Champaign, Ill.

[21] Appl. No.: 162,631

[22] Filed: Mar. 1, 1988

[51] Int. Cl.[5] ..... H01P 1/202; H01P 1/212

[52] U.S. Cl. ..... 333/12; 333/206

[58] Field of Search ..... 333/245, 263, 206, 12, 333/24 C

[56] References Cited

U.S. PATENT DOCUMENTS

| | | | |
|---|---|---|---|
| 3,393,384 | 7/1968 | Bailey et al. | 333/206 |
| 3,970,969 | 7/1976 | Sirel et al. | 333/12 |
| 4,204,549 | 5/1980 | Paglione | 333/295 X |
| 4,303,899 | 12/1981 | Barley et al. | 333/263 X |
| 4,399,419 | 8/1983 | Dobrovolny | 333/12 |
| 4,559,506 | 12/1985 | Capek | 333/181 |

OTHER PUBLICATIONS

Sage Laboratories Inc.-"Standard DC Blocks (Noise Suppressors)", date unknown.

*Primary Examiner*—Eugene R. LaRoche
*Assistant Examiner*—Benny T. Lee
*Attorney, Agent, or Firm*—Michael D. Rechtin; Philip P. Mann

[57] ABSTRACT

An isolator for insertion in a coaxial cable between an RF generator and a device employing RF energy provides isolation against DC and low frequency (60 Hz) AC while passing the RF energy with low attenuation and a low reflection ratio. The isolator has a longitudinally extending central conductor spacedly surrounded by an inner conductor. The central conductor and inner conductor are connectable to the ends of the center conductor of the coaxial RF cable. A first outer conductor of the isolator spacedly surrounds the inner conductor and a second outer conductor spacedly surrounds the first outer conductor. Insulators are provided between the central and inner conductors, between the inner conductor and the first outer conductor and between the two outer conductors. The outer conductors of the isolator are connectable to the sheath of the coaxial RF cable.

4 Claims, 2 Drawing Sheets

LOW FREQUENCY ISOLATOR FOR RADIO FREQUENCY HYPERTHERMIA PROBE

The present invention is directed to an isolator for use with high frequency hyperthermia equipment. The isolator of the present invention electrically isolates the patient undergoing hyperthermia treatment from direct current and low frequency AC current, such as 60 Hz current, thereby enhancing patient safety.

Diseased tissue, such as tumorous tissue, possesses a greater susceptibility to destruction by elevated temperatures than does normal tissue. This has lead to the use of high temperature or "hyperthermia" in treating cancer and other diseases.

One way of generating the elevated temperature is to subject the diseased tissue to electromagnetic energy in the radio frequency range. For this purpose, high frequency electromagnetic energy emitters or probes may be inserted in the tumor or other tissue volume to be treated. The probes are connected by a shielded, or coaxial, cable to a radio frequency generator that supplies electromagnetic energy of a desired high frequency.

Since the radio frequency probe is placed within the body of the patient, it is important to electrically isolate the probe to eliminate shock hazard to the patient. Without isolation, low frequency AC or DC originating in the power supply poses a threat to patient safety. Such low frequency AC or DC is often termed "leakage".

A shock hazard may also arise if the patient must be defibrillated with high voltage direct current when a hyperthermia probe is in use. If proper isolation is not provided, the probe could form an electrical ground that would result in excessive current through the patient's body. Were the current to pass through the heart, serious consequences could ensue.

Due to the foregoing, testing and standards organizations, such as Underwriters Laboratories, have established electrical isolation specifications and the leakage and high voltage isolation characteristics required to meet such specifications. If the specification cannot be met, the hyperthermia equipment must contain a warning label, such as "Patient Not Isolated".

It is, therefore, the object of the present invention to provide an improved isolator suitable for providing isolation against DC or low frequency AC while passing high radio frequency electromagnetic energy of a desired frequency. The isolator passes the desired frequency of radio frequency energy with low attenuation and low reflection ratio. The isolator is particularly useful in increasing patient safety in high frequency hyperthermia equipment.

The isolator of the present invention is simple and economical in construction and employs the conventional connectors commonly in use with conventional coaxial cables for RF energy.

Briefly, the isolator of the present invention includes a longitudinally extending central conductor spacedly surrounded by an inner conductor. When inserted in the coaxial cable between an RF generator and a device, such as a probe, employing the RF energy, central conductor and inner conductor are connectable to the ends of the center conductor of the coaxial RF cable. A first outer conductor of the isolator spacedly surrounds the inner conductor and a second outer conductor spacedly surrounds the first outer conductor. The outer conductors of the isolator are connectable to the sheath of the RF coaxial cable. The central and inner conductors and the first and second outer conductors are capacitively coupled at the desired RF frequency. Insulators are provided between the central and inner conductors, between the inner conductor and the first outer conductor, and between the two outer conductors.

DC and low frequency AC isolation is obtained by the insulators between the various conductors of the isolator. The capacitive and inductive reactance of the isolator also serves to block low frequency AC while at the same time passing the high, radio frequency energy. The geometry and construction of the isolator is selected to maintain the 50 ohm impedance of the coaxial RF cable.

The present invention will be further understood from the following detailed description taken in conjunction with the drawing.

In the drawing:

FIG. 3 is a detailed fragmentary view showing a portion of the isolator.

Figure 1:
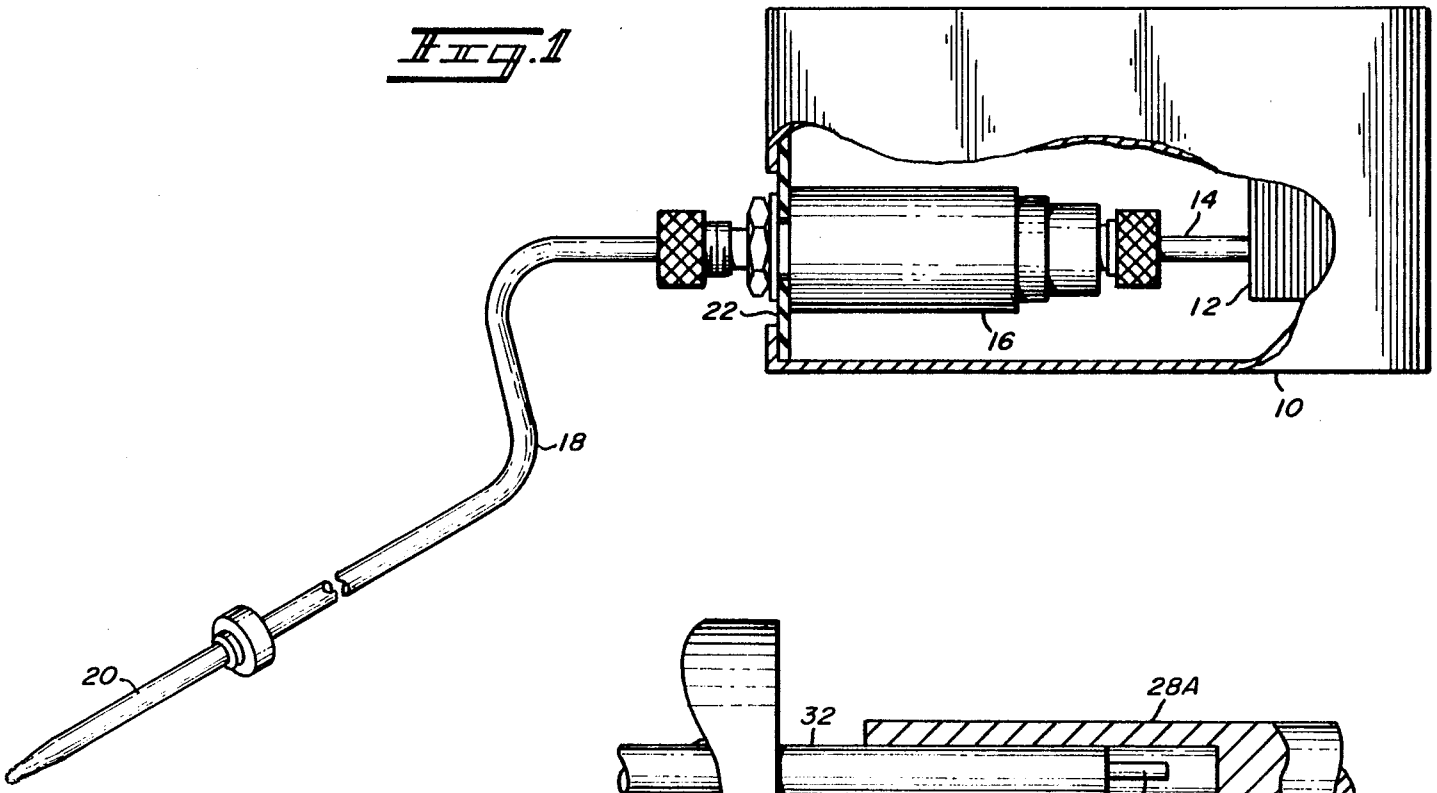
FIG. 1 is a view of the isolator of the present invention as used in hyperthermia apparatus.

In FIG. 1, RF generator 10 provides radio frequency electromagnetic energy of the desired frequency. Typical medical hyperthermia equipment may employ RF energy having a frequency of 915 megahertz. The output of the radio frequency generating portions 12 of generator 10 is provided to radio frequency cable 14 and, in turn, to one end of isolator 16 of the present invention. Cable 14 may be of the conventional coaxial type having a center conductor surrounded by a dielectric or insulator. The dielectric is surrounded by an exterior sheath of metallic braid that, in turn, is surrounded by a plastic covering. Cable suitable for use as cable 14 is commonly available having a predetermined impedance, such as 50 ohms. Such a cable may bear industry designations such as RG316, RG58 or RG8.

Radio frequency cable 18, similar in construction to radio frequency cable 4, extends between isolator 16 and hyperthermia probe 20 that is placed in the body tissue to be treated.

Figure 2:
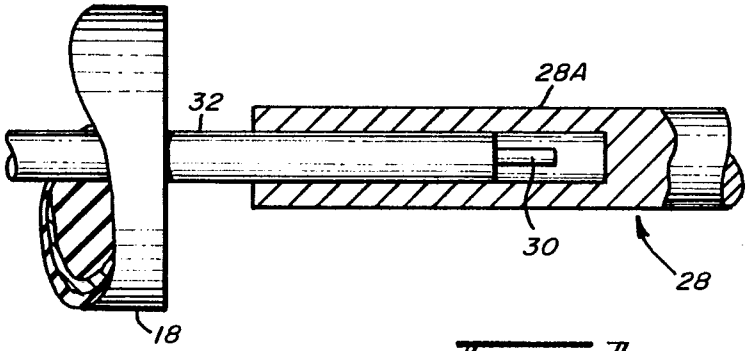
FIG. 2 is a cross sectional view of the isolator of the present invention.
Figure 2:
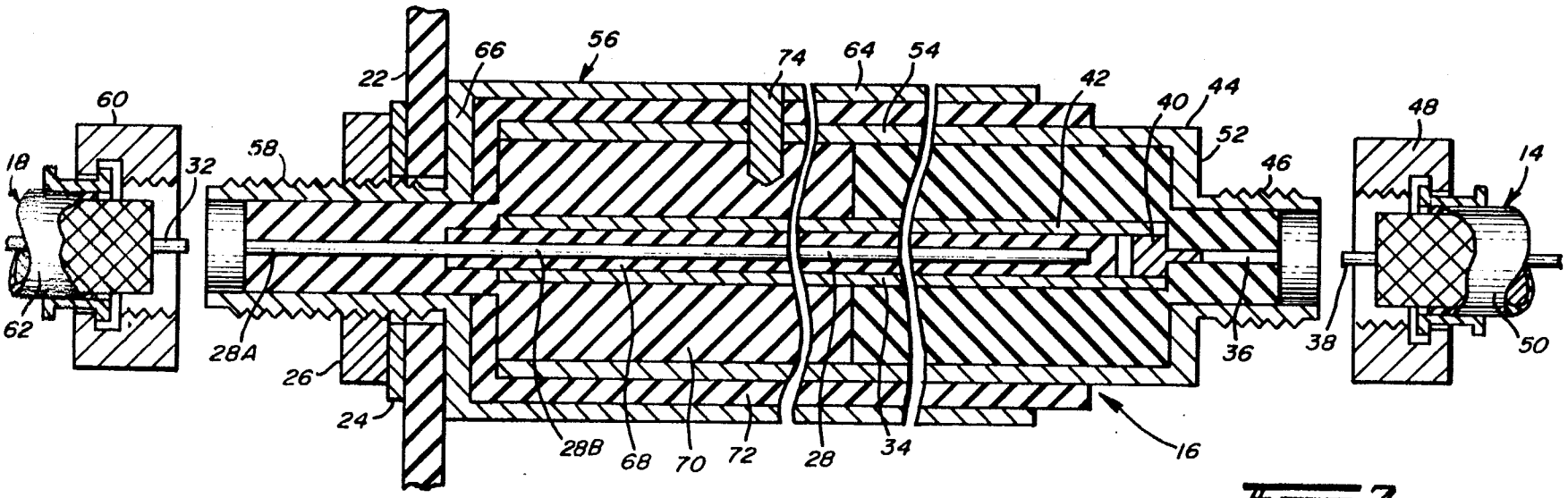

FIG. 2 shows the details of isolator 16 of the present invention. Isolator 16 is secured in an insulating wall 22 of generator 10 by washer 24 and nut 26.

Isolator 16 includes central conductor 28 for connection to the center conductor of probe cable 18. Central conductor 28 may comprise a solid rod formed of brass wire. As shown in detail in FIG. 3, central conductor 28 has a hollow end with circumferentially spaced longitudinal slits 30 that enable central conductor 28 to receive and retain center conductor 32 of probe cable 18. For ease of fabrication, the end 28A of central conductor 28 may be separate from the remaining portion 28B (FIG. 2). The foregoing arrangement also permits the length of central conductor 28 to be altered and fixed to establish the inductive reactance of isolator 16 at a desired magnitude, such reactance being established by the circumferential surface area of central conductor 28.

Inner conductor 34 is provided in isolator 16 to surround central conductor 28. Inner conductor 34 has extension 36 that is hollow in the portions adjacent the input end of isolator 16, in the manner shown in FIG. 3. The hollow end of extension 36 may also contain circumferentially spaced longitudinal slits, also as shown in FIG. 3. Extension 36 can thus receive the inner conductor 38 of RF cable 14. Extension 36 includes integral enlarged portion 40 that mates with sleeve-like portion 42 that surrounds central conductor 28. Extension 36 and integral portion 40 may be formed of beryllium copper. Sleeve-like portion 42 may be formed of brass tubing.

Outer conductor 44 includes threaded tubular portion 46 for receiving threaded collar 48 of a conventional connector for RF cable 14 to retain the connection between the cable and the isolator. The sheath 50 of coaxial cable 14 lies along the inside of tubular portion 46 to connect the sheath of cable 14 to outer conductor 44. Outer conductor 44 has annular portion 52 intermediate threaded tubular portion 46 and tubular portion 54. Outer conductor 44 may be formed of passivated stainless steel or beryllium copper.

At the output end of isolator 16, outer conductor 56 has threaded tubular portion 58 that receives collar 60 of a conventional connector that retains probe cable 18 in connection with isolator 16. The sheath 62 of probe cable 18 contacts the inner surface of threaded tubular portion 58 when probe cable 18 is connected to outer conductor 56. Threaded tubular portion 58 is connected to exterior tubular portion 64 through annular portion 66. Outer conductor 56 may be formed of beryllium copper or passivated stainless steel.

Central conductor 28 is electrically insulated from inner conductor 34 by insulator 68. Inner conductor 34 is electrically insulated from outer conductor 44 by insulator 70. Insulator 70 also forms the insulation in threaded tubular portions 46 and 58 at the input and output ends, respectively, of isolator 16. Outer conductor 44 is insulated from outer conductor 56 by insulator 72. Insulators 68, 70, and 72 may be formed of tetrafluoroethylene or other suitable non-conductive material. In order to assemble isolator 16, insulator 70 is formed in two parts. After assembly, the parts of isolator 16 are retained together by non-conductive pin 74. Pin 74 extends through outer conductor 56, insulator 72, and outer conductor 44 into insulator 70.

While certain materials have been noted in connection with the foregoing description of the conductors and insulators in isolator 16, it will be appreciated that any suitable electrically conducting material can be used for the conductors and any suitable electrically non-conducting material can be used for the insulators. Also, while isolator 16 has been described in a particular connection configuration with respect to radio frequency cables 14 and 18, isolator 16 is electrically symmetrical so that high frequency energy may be transmitted in either direction through the isolator.

The geometry and construction of isolator 16, including the size of central conductor 28, the spacing of the various conductors, and the dielectric strength of the insulators, are selected so as to maintain a 50 ohm impedance in the transmission of the RF energy from radio frequency generator 10 to probe 20 through the RF cables and isolator.

DC isolation, both for DC leakage from radio frequency generator 10, as well as for the DC employed in defibrillation, is obtained by the dielectric properties of insulators 68, 70, and 72. The insulators are selected to have a dielectric strength that equals, and preferably exceeds that required by applicable standards and specifications. The dielectric properties of insulator 68, 70, and 72 also provide isolation for low frequency AC voltages. The frequency pass characteristics of isolator 16 also serve to block low frequency AC voltages.

Figure 4:
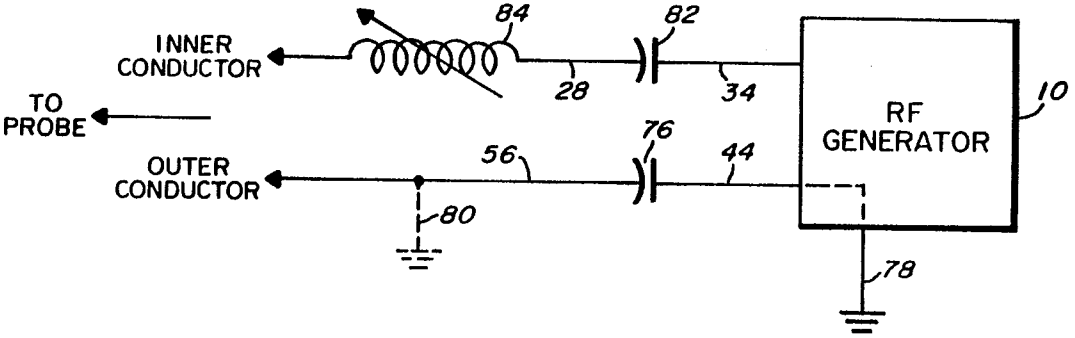
FIG. 4 is a schematic diagram illustrating the electrical characteristics of the isolator.

Outer conductors 44 and 56 are capacitively coupled together at the desired high frequency of source 10, as shown schematically at 76 in FIG. 4. Outer conductor 44 is connected to system ground 78 of radio frequency generator 10. Outer conductor 56 forms a floating ground 80 for the radio frequency energy.

A similar capacitive coupling 82 is formed between inner conductor 34 and central conductor 28.

The capacitance of the couplings is established by the geometry of the conductors including the spacing and amount of overlap between outer conductors 44 and 56 and between inner and central conductors 34 and 28.

In addition to the capacitive coupling between inner conductor 34 and central conductor 28, there also exists an inductive reactance 84 in isolator 16 determined by the circumferential surface area of central conductor 28. Inductive reactance 84 and the capacitive reactance of capacitive coupling 82 at the desired operating frequency of probe 20 are established such as to permit passage of RF energy having the desired frequency through isolator 16 with a low attenuation and low reflection ratio. Inasmuch as the value of the capacitive reactance tends to be fixed by the geometry of isolator 16, the inductive reactance is altered by altering the length of inner conductor 34 to establish the desired RF properties of isolator 16.

Various modes of carrying out the invention are contemplated as being within the scope of the following claims particularly pointing out and distinctly claiming the subject matter which is regarded as the invention.

We claim:

1. An isolator insertable in a RF supply line extending from a source of RF energy to a device employing the RF energy, said isolator providing isolation to the device against DC and low frequency AC while passing RF energy of a selected frequency, said RF supply line having an center conductor and an exterior conductor, said isolator comprising:

a central conductor connectable to the center conductor of the RF supply line at a first end of said isolator, said central conductor comprising two longitudinally adjacent parts;

an inner conductor spacedly surrounding said central conductor, said inner conductor being connectable to the center conductor of the RF supply line at a second end of said isolator, said central and inner conductors being electrically coupled together at the selected frequency of the RF energy;

a first outer conductor spacedly surrounding said inner conductor, said first outer conductor being connectable to the exterior conductor of the RF supply line at said second end of said isolator;

a second outer conductor spacedly surrounding said first outer conductor, said second outer conductor being connectable to the exterior conductor of the RF supply line at said first end of said isolator, said first and second outer conductors being electrically coupled together at the selected frequency of the RF energy; and insulating means between said central and inner conductors, said inner conductor and said first outer conductor, and said first and second outer conductors.

2. An isolator insertable in a RF supply line extending from a source of RF energy to a device employing the RF energy, said isolator providing isolation to the device against DC and low frequency AC while passing RF energy of a selected frequency, said RF supply line having an center conductor, and an exterior conductor, said isolator comprising:

a central conductor connectable to the center conductor of the RF supply line at a first end of said isolator;

an inner conductor spacedly surrounding said central conductor, said inner conductor being connectable to the center conductor of the RF supply line at a second end of said isolator, said central and inner conductors being electrically coupled together at the selected frequency of the RF energy;

a first outer conductor spacedly surrounding said inner conductor, said first outer conductor being connectable to the exterior conductor of the Rf supply line at said second end of said isolator;

a second outer conductor spacedly surrounding said first outer conductor, said second outer conductor being connectable to the exterior conductor of the RF supply line at said first end of said isolator, said first and second outer conductors being electrically coupled together at the selected frequency of the RF energy; and insulating means between said central and inner conductors, said inner conductor and said first outer conductor, and said first and second outer conductors, said insulating means between said inner conductor and first outer conductor being formed in two parts.

3. The isolator according to claim 2 wherein said isolator has an assembled condition and wherein said isolator further includes means for retaining the elements of said isolator in the assembled condition.

4. The isolator according to claim 3 wherein said retaining means comprises a pin extending through said first and second outer conductors and the contiguous insulating means.

* * * * *